United States Patent [19]

Foik et al.

[11] 3,990,746

[45] Nov. 9, 1976

[54] APPARATUS FOR AND A METHOD OF STORING AND TRANSPORTING LINING SECTIONS IN AN UNDERGROUND TUNNEL DRIVING INSTALLATION

[75] Inventors: Adolf Foik; Hans Schigulski, both of Altlunen, Germany

[73] Assignee: Gewerkschaft Eisenhutte Westfalia, Westfalia, Germany

[22] Filed: June 9, 1975

[21] Appl. No.: 585,300

[52] U.S. Cl. ..... 299/11; 61/42; 61/84; 105/161; 105/180; 105/364; 214/1 MS; 214/38 CC; 299/18; 299/33

[51] Int. Cl.[2] ..... E21D 11/40; E21F 13/02

[58] Field of Search ..... 299/12, 33, 18, 11; 61/42, 43, 84, 45; 214/1 MS, 38 CC; 104/138 R; 105/161, 364, 180

[56] References Cited

UNITED STATES PATENTS

| | | | |
|---|---|---|---|
| 168,146 | 9/1875 | Dowd | 61/84 |
| 916,531 | 3/1909 | Carr | 61/42 X |
| 2,128,172 | 8/1938 | Warner et al. | 61/48 |
| 3,219,199 | 11/1965 | Lagerstrom | 214/1 MS |
| 3,483,829 | 12/1969 | Barry | 104/88 X |
| 3,812,679 | 5/1974 | Ruemmele | 61/42 |
| 3,813,885 | 6/1974 | Tabor | 61/42 X |

*Primary Examiner*—Ernest R. Purser
*Assistant Examiner*—William F. Pate, III
*Attorney, Agent, or Firm*—Thompson, Birch, Gauthier & Samuels

[57] ABSTRACT

A tunnel driving installation has an advanceable support shield and cutting means co-operating at the front end of the tunnel and a continuous tunnel lining disposed rearwardly of the support shield and constructed from individual lining sections. In order to store and transport the tunnel lining sections within the tunnel lining apparatus is provided which comprises storage stations respectively located at the front and rear regions of the tunnel and a trolley vehicle for moving back and forth between the stations. The trolley vehicle has a container which serves to receive debris removed by the cutting means, and beneath the container the vehicle has shaped plates which serve to locate and support a series of lining sections. Both storage stations are composed of T-shaped rails laid on the tunnel floor so that the vehicle can pass over the rails. The rails of the rear station can be raised and lowered to effect transfer of the sections thereon to the plates of the vehicle whereas a lever or the like is provided at the front storage station to selectively cause the sections to slide along the plates of the vehicle onto the rails as the vehicle is moved. The front storage station moves up to follow the tunnelling progress and additional equipment is provided to take the lining sections from the front storage station and to place the sections in position to increase the length of the lining as the tunnelling progresses.

16 Claims, 3 Drawing Figures

APPARATUS FOR AND A METHOD OF STORING AND TRANSPORTING LINING SECTIONS IN AN UNDERGROUND TUNNEL DRIVING INSTALLATION

BACKGROUND OF THE INVENTION

The present invention relates in general, to apparatus for, and a method of storing and transporting lining sections in an underground tunnel driving installation.

In tunnel driving installations in which, as is known, the driving or advancement of the tunnel is effected by means of a cutting head working in co-operation with a movable support shield at the front end of the tunnel, support of the tunnel wall behind the shield is usually achieved by a permanent tunnel lining.

Although it is known to form such a lining with concrete cast in-situ the invention is concerned with installations of the above-mentioned type in which the lining is composed of a series of prefabricated lining sections usually made of steel or concrete. In order to actually install these sections in position to support the tunnel wall as the tunnel progressively lengthens it is usual to employ an erecting means or device which places the sections at the desired location and which moves up with the shield as the tunnel advances. It is obviously desirable for an adequate supply of lining sections to be provided for the erecting means otherwise delays will occur and these sections have to be transported along the tunnel from its entrance, usually communicating with a shaft or similar excavation. To effect such transport, it has been known hitherto to utilize expensive chain or rail conveyors and/or similar means and to load and unload the sections several times along the tunnel in a typical installation. It is also difficult to arrange the transportation means so that it does not interfere with the other services, for example, the conveying of the debris or spoil. In any event in the cramped conditions prevailing in the tunnel the unloading and storage of the lining sections is generally problematic.

A general object of this invention is to provide an improved method of and apparatus for transporting and storing tunnel lining sections which will at least mitigate some of the disadvantages of the prior art.

SUMMARY OF THE INVENTION

According to one aspect of the invention there is provided apparatus for use in storing and transporting lining sections in an underground tunnel driving installation; said apparatus comprising a storage station for receiving and storing a series of lining sections in the vicinity of the entrance to a tunnel and a trolley vehicle adapted to move along the tunnel within a previously installed lining and having holding means which serves to receive and support the lining sections to be transported, the trolley vehicle and the storage station being so constructed as to permit the trolley vehicle to travel over the station to pick up lining sections stored thereat.

Preferably the apparatus also has a further storage station for receiving and storing a series of lining sections in the vicinity of the front end of the tunnel, the trolley vehicle serving to transfer lining sections between the first-mentioned storage station and the further storage station. Similarly to the first station, the further station disposed at the forward end of the tunnel is constructed to permit the trolley vehicle to travel over the further storage station and to deposit lining sections thereon.

According to another aspect of the invention there is provided a method of storing and transporting lining sections in an underground tunnel driving installation; said method comprising arranging a series of lining sections at a first storage station in the vicinity of the tunnel entrance, moving a trolley vehicle along the tunnel and within a previously installed lining towards the entrance to travel over the first storage station, transferring the lining sections from the first storage station to holding means of the vehicle, moving the vehicle towards the front end of the tunnel to travel over a second storage station in the vicinity of the front end of the tunnel and transferring the lining sections from the holding means to the second storage station.

The transference of lining sections from the first storage station to the trolley vehicle can take place without the use of ancilliary equipment as hitherto known. In a preferred arrangement the vehicle can pass over the lining sections at the first storage station and relative vertical movement between the station or a part of the station and the holding means of the vehicle can cause the lining sections to become picked-up by the holding means for subsequent movement with the vehicle.

According to a further advantageous feature of the invention the trolley vehicle also serves to transport debris material away from the front end of the tunnel. Thus, in one form of construction the trolley vehicle has a container for receiving debris material removed from a working face during the advancement of the tunnel, the holding means being formed beneath said container. The trolley vehicle can have wheels which locate in tracks extending along the tunnel. The vehicle can convey debris material as it moves from the front to the rear of the tunnel and then lining sections as it moves back from the rear to the front. In this way the apparatus does not take up unnecessary space or interfere with other operations. The holding means of the vehicle can be made in a variety of constructions. In once especially simple form where the holding means is not intended to move relative to the vehicle, plates constituting locating and retaining members can be disposed beneath the container of the vehicle and spaced apart laterally thereof between its running wheels. These plates can extend beneath and support a series of lining sections and it is preferred to provide the plates with concave support surfaces with a curvature conforming to that of the lining sections. If this construction is adopted it is then preferable to make at least part of the first storage station raisable and lowerable to enable the sections to be deposited onto the locating and retaining members or plates. It is however feasible to make the holding means raisable and lowerable for the same purpose. The raisable and lowerable part of the storage station may in fact be in the form of two parallel rails mounted on the floor of the tunnel and serving to raise the lining sections thereon to enable the vehicle and more particularly the holding means, to pass freely under the lining sections or to lower the sections onto the holding means when desired. Various forms of lifting device can be employed for this purpose although in a preferred arrangement the rails, which are of T-shaped cross-section, are displaced longitudinally by moving means such as pistons and cylinder for example to slide or engage or abutments or rollers which effect the raising or lowering.

The transferrence of the lining sections between the first storage station and the vehicle can take place entirely automatically if desired. Preferably means is additionally provided to load the lining sections onto the storage station for take-up by the holding means of the vehicle. Stop means is preferably also provided to prevent inadvertent displacement of the lining sections from the holding means or from other parts of the apparatus.

As regards the further/or second storage station at the front end of the tunnel this can be constructed along similar lines to the first storage station and employ parallel rails. However, here an advantageous form of transference of the sections can take place under the action of a lever or the like which permits the sections retained by the holding means to pass with the vehicle towards the working face of the tunnel but which prevents their reverse movement to thereby push the sections onto the rails as the vehicle moves back to the rear of the tunnel. In this case no lifting or vertical movement is required. A special winch or similar conveying means can push the lining sections along the rails of the forward storage station to present the sections to a crane which lifts the sections individually to the erecting means.

The invention may be understood more readily and various other features of the invention may become apparent from consideration of the following description.

BRIEF DESCRIPTION OF DRAWINGS

An embodiment ofo the invention will now be described, by way of example only with reference to the accompanying drawings where.

DESCRIPTION OF PREFERRED EMBODIMENT

Figure 1:
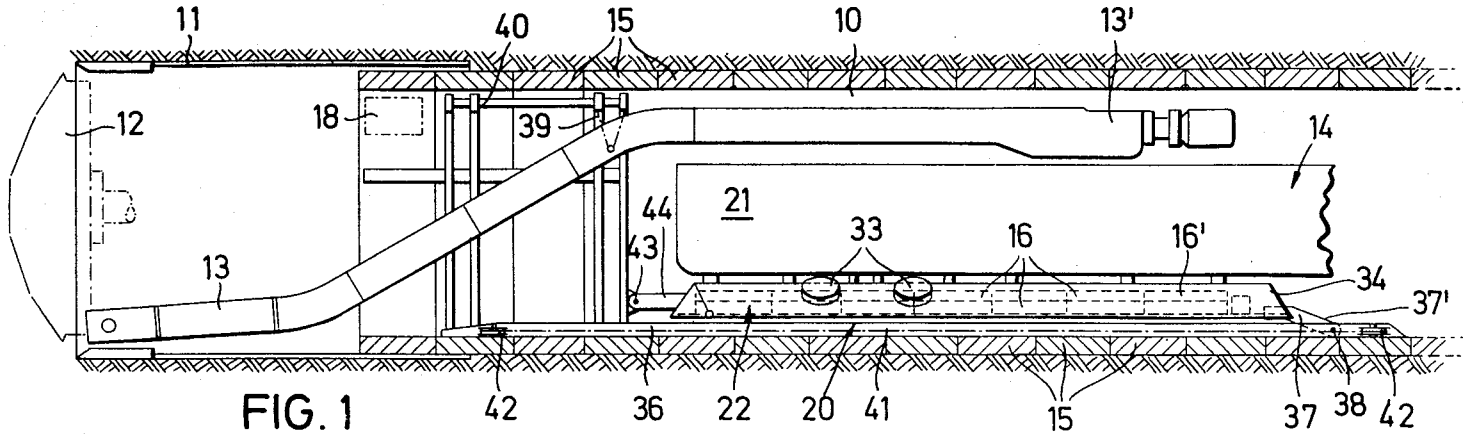
FIG. 1 is a schematic sectional side view of the foremost region of a tunnel driving installation employing storage and transportation apparatus made in accordance with the invention.

As shown in FIG. 1 the tunnel driving installation has, in known manner, a rotatable cutting head 12 arranged partly within a movable shield 11 which can be a knife shield with a cutting edge. The shield 11 supports the wall of the tunnel which is generally designated by reference numeral 10 over the extreme forward region. The cutting head 12 serves to attack the working face of the tunnel 10 and the material or spoil removed from the face is taken up by a conveyor 13 located partly within the shield 11 which is advanced from time to time. The conveyor 13, which can conveniently take the form of a scraper-chain conveyor, has its forward part in the shield 11 disposed near the floor of the shield 11 and supported thereby. This forward part of the conveyor 13 adjoins an inclined intermediate part which in turn adjoins an elevated rear part which extends more or less parallel to the axis of the tunnel. This rear part of the conveyor 13 is disposed near the roof of the tunnel and has a discharge zone 13′ whereat the material can fall into a container or bunker 21 supported by a trolley vehicle 14. The drive means for the conveyor 13 is arranged at the rear end of the rear part as shown.

Figure 2:
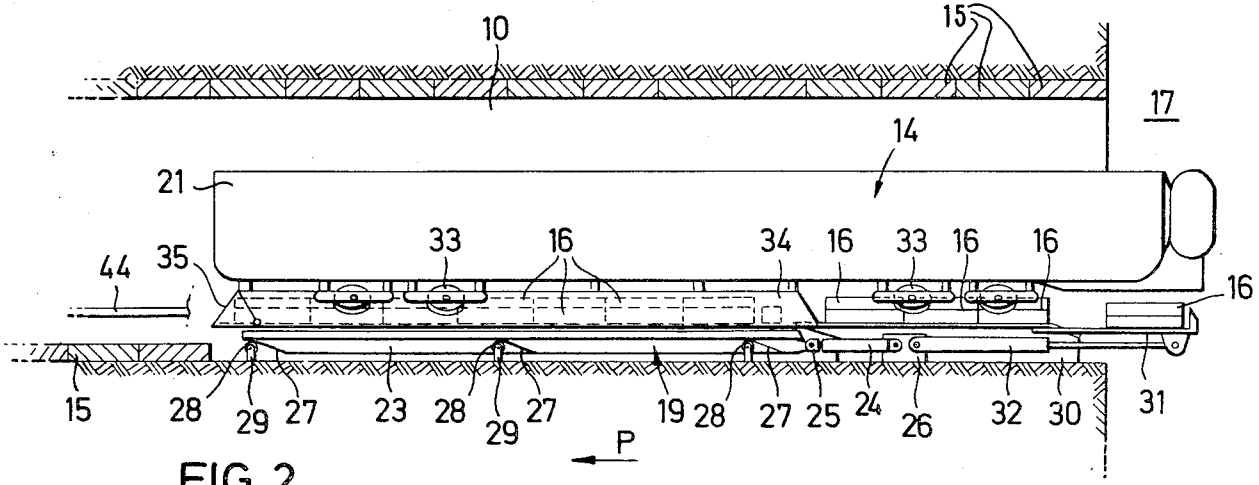
FIG. 2 is a schematic sectional side view of the rearmost region of the installation.

Rearwardly from the shield 11 relative to the working face is a permanent tunnel lining composed of individual annular members 15 disposed end-to-end. Each annular member 15 is itself composed of a plurality of segments or sections denoted 16. The sections 16 of each member 15 are arranged side-by-side so that their radial end faces contact one another. Thus the lines of separation between the sections 16 extend radially of the member 15 composed therefrom. The sections 16 are pre-fabricated and are usually made from steel or concrete. As the shield 11 and the cutting head 12 advance to extend the tunnel the exposed wall of the tunnel is to be supported by newly-installed members 15 and to this end a crane 39 and an erecting means 18 (not shown in detail but of known design) are used to transfer and locate the individual sections 16 in position to form the members 15. If the tunnel driving is to progress at high speed it is important to ensure that an adequate supply of lining sections 16 is available at the forward region of the tunnel 10 for take-up by the crane 39 and the erecting means 18. Access to the tunnel 10 itself is by way of a shaft 17 or similar excavation at the rear end as shown in FIG. 2 and in accordance with the invention storage and transportation apparatus is provided to store and transport the sections 16 between the entrance or rear end of the tunnel 10 in the vicinity of the shaft 17 to the forward end of the tunnel 10. This storage and transportation apparatus is essentially composed of a first or rear storage station 19 disposed in the vicinity of the entrance to the tunnel adjacent the access shaft 17, a second or forward storage station 20 disposed in the vicinity of the crane 39 and the erecting means 18 and a holding or location means 22 formed beneath the box-like superstructure of the container 21 of the trolley vehicle 14. The trolley vehicle 14 itself thus serves to transport the sections 16 between the stations 19, 20 and for this purpose the vehicle 14 is permitted to move over the stations 19, 20 as will be described.

Dealing firstly with the rear station 19, as shown in FIG. 2 this comprises two parallel rails 23 disposed along the floor of the tunnel 10. These rails 23 each have a T-shaped cross-section, as can be seen from FIG. 3 and the rails 23 can be raised or lowered and in this construction, simultaneously moved in direction parallel to the axis of the tunnel. To effect such displacement piston and cylinder units 24 are provided. These units 24 may be hydraulically or pneumatically operated. Each unit 24 is disposed parallel to the axis of the tunnel 10 and at the floor region thereof. The piston rods of the units 24 are pivotably connected to the rear ends of the rails 23 and the cylinders of the units 24 are pivotably connected to abutments in the form of brackets 26 suitably affixed to the floor of the tunnel. The upper flanges of the rails 23 serve to contact and support a series of lining sections 16 arranged end-to-end and the disposition of the sections 16 in relation to the rails 23 can best be appreciated from FIG. 3. Beneath these upper flanges, the rails 23 are provided with inclined cam surfaces 27 which contact abutments or support rollers 28 spaced apart longitudinally and laterally of the tunnel 10. Each roller 28 is rotatably mounted on a block 29 or the like again affixed to the floor of the tunnel. As can be appreciated from FIG. 2, if the piston rods of the units 24 are extended the rails 23 are shifted longitudinally of the tunnel in the direction of arrow P. The rollers 28 contacting the surfaces 27 of the rails 23 thus effect raising of the rails 23.

Conversely, if the piston rods of the units 24 are retracted the rails 23 are shifted in the reverse direction to the arrow P and are lowered to adopt the position shown in FIG. 2. A stationary platform conveniently in the form of two rails, generally denoted 30, is disposed between the shaft 17 and the rails 23 and these further support rails may be similar to the rails 23.

A table 31 is slidably mounted in relation to the support rails 30 and piston and cylinder units 32 are used to move the table 31 along the support rails 30 and towards or away from the rails 23, i.e., in the direction of the arrow P or reverse thereto. As shown, the table 31 may have tongues or the like which slidably engage beneath the upper flanges of the rails 30. The cylinders of the units 32 are pivotably connected to the brackets 26 and the piston rods of the units 32 are pivotably connected to the table 31. The table 31 has a lug or similar projection at the rear edge to prevent the sections 16 delivered thereto from falling off the table 31. The table 31 and the rails 30 are disposed at such a height that lining sections 16 thereon can be transferred smoothly onto the rails 23 aligned therewith when the rails 23 are in their uppermost position. The sections 16 can be transferred from the table 31 onto the rails 30 one at a time with the front section 16 already on the rails 30 being urged forwards in the direction of the arrow P onto the rails 23. The rails 23 are of sufficient length to accommodate a fairly large number of sections 16 and as illustrated seven sections 16 are located on the rails 23 while three sections are located on the rails 30.

Figure 3:
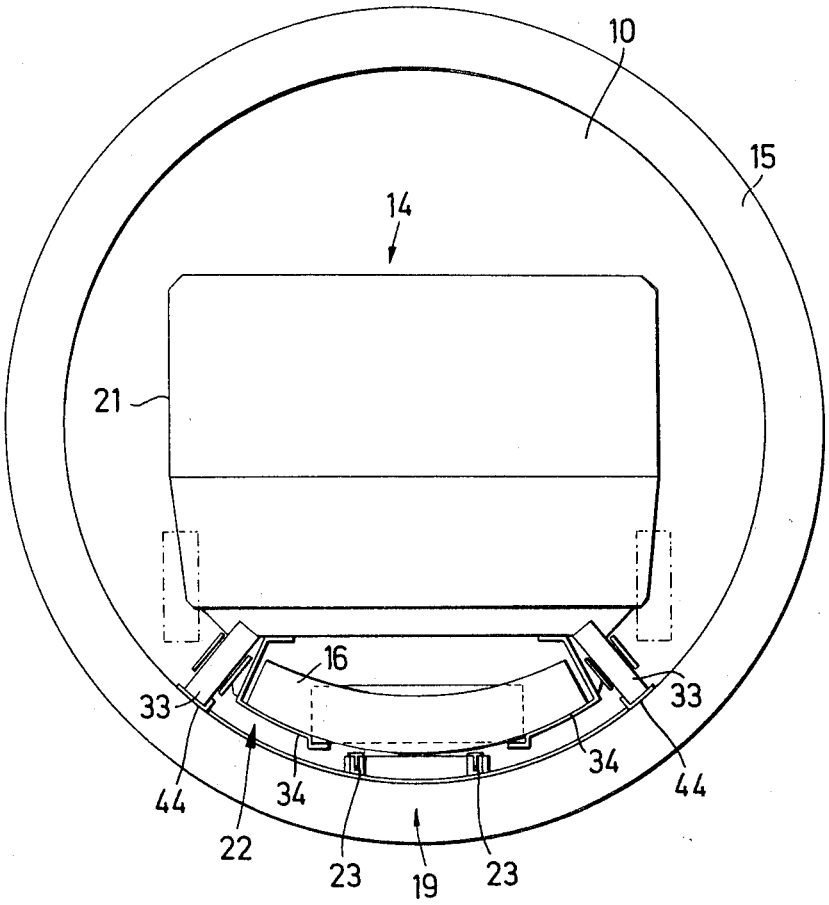
FIG. 3 is a schematic end view of a trolley vehicle forming part of the storage and transportation apparatus.

The holding means 22 of the trolley vehicle 14 is, as shown in FIG. 3, positioned symmetrically between wheels 33 of the vehicle 14. These wheels 33 have axes of rotation inclined in relation to the axis of the tunnel 10 so as to conform to the curvature of the wall thereof. The wheels 33 locate on L-shaped tracks 44 running along the tunnel 10 so that the vehicle 14 can be moved along the tunnel 10 as desired. The vehicle 14 can be propelled in a variety of ways as is desired, one example being by means of a winch cable. The holding means 22 is in the form of two parallel shaped locating and retaining members 34 conveniently positioned at the underside of the chassis of the vehicle 14. The members 34 are spaced apart laterally of the tunnel 10 and can be made from sheet metal. The members 34 have concave support surfaces with a curvature conforming to that of the sections 16 so that as illustrated in FIG. 3, the sections 16 arranged end-to-end can be located and supported by these surfaces. The members 34 can extend over the entire length of the vehicle 14 or else only over a part thereof as depicted in the drawings. As represented by broken lines in FIG. 2, some seven sections 16 can be accommodated by the location means 22, i.e., the same number as stored on the rails 33 of the storage station 19. In order to prevent the sections 16 from being pushed out from the front of the vehicle 14 stop means in the form of a closure flap 35 is provided. As shown in FIG. 1, the front storage station 20 is in a similar manner to the rear storage station 19 composed of two parallel rails 36 which have a T-shaped cross-section so that their upper flanges can contact and support the sections 16. At the rear end of the station 19 there is provided a lever 37 which is supported for pivoting about a spindle 38 extending transversally between the rails 36. The lever 37 serves as stop means for engaging on the rearmost section 16' on the holding means 22 of the vehicle 14. Means is provided to effect pivotal movement of this lever 37 between the stop position, as represented in FIG. 1, and an inoperative position where the lever 37 is pivoted towards the floor. This means can take the form of a piston and cylinder unit (not shown) but it is preferred to utilize spring means (not shown) which biases the lever 37 into the stop position. The lever 37, being shaped as shown in FIG. 1, can thus pivot downwards against the force of the spring when its face 37' is engaged by the vehicle 14, for example by the flap 35, and the vehicle 14 can then pass over the lever 37 until the latter is allowed to pivot upwards under the force of the spring, to its stop position when the rearmost section 16' has travelled beyond the face 37'.

As described hereinafter the sections 16 carried by the holding means 22 of the vehicle 14 are transferred to the carrier rails 36 when the vehicle 14 is moved rearwardly of the face.

In order to transfer the sections 16 from the carrier rails 36 to the erecting means 18 the crane 39 is used. This crane 39 is displaceably supported by a frame or chassis 40. In order to present each section 16 to the crane 39 in turn a mechanism in the form of a chain conveyor or a winch is provided for pushing the sections 16 along the rails 36 with the aid of a plate or the like extending across the tunnel 10. As represented in the drawings, this mechanism of this construction employs a winch cable 41 entrained around pulleys 42 conveniently moveable with the rails 36. The frame 40 for the crane 39 must advance as the tunnel driving progresses and it is preferable to connect the rails 36 to the frame 40 so that the rails 36 also advance with the frame 40. The tracks 44 for the wheels 33 should also extend as the tunnel progresses and it is desirable to introduce fresh lengths of track 44 at the rear of the tunnel near the shaft 17. As depicted in FIG. 1, the front ends of the tracks 44 can then be articulated as at 43, to the frame 40 so that the tracks 44 also move up with the frame 40. The intermediate part of the conveyor 13 and the erecting means 18 can also be supported by the frame 40 so as to advance therewith.

The complete operation of the storage and transportation apparatus is as follows:

Individual lining sections 16 are deposited onto the table 31 and the units 32 serve to transfer these sections 16 in succession over the rails 30 onto the rails 23 when aligned therewith in their uppermost position. A number of sections commensurate with the capacity of the holding means 22 of the vehicle 14 would thus be supported and stored end-to-end on the rails 23 while further sections 16 are supported and stored on the rails 30. The process of arranging the sections 16 on the rails 23 can occur while the vehicle 14 is at the front region of the tunnel 10 or in transit. Assume now that at the front end region of the tunnel 10 the container 21 of the vehicle 14 is being loaded with debris material by the conveyor 13 while the desired number of sections 16 are stored on the rails 23. The vehicle 14 then moves rearwardly back to the rear end region of the tunnel 10 with the holding means 22 empty.

The vehicle 14 passes over the rails 23 and the sections 16 thereon and as shown in FIG. 3 the rails 23 locate between the inner edges of the locating or retaining members 34 of the holding means 22. Because the rails 23 are in their uppermost position the sections 16 are lifted clear of the members 34. The material in the container 21 of the vehicle 14 can then be unloaded in the normal way and removed via the excavation shaft 17. The rails 23 can be lowered at any stage now by means of the units 24 to deposit the sections 16 onto the members 34 of the vehicle 14. The vehicle 14 is then moved back to the front end region of the tunnel 10 and the lever 37 trips to permit the vehicle 14 to pass over the rails 36. The lever 37 then reverts back to its stop position engageable with the rearmost section 16' on the members 34. The container 21 of the vehicle 14 is then recharged with debris material and eventually the vehicle 14 is moved back again to the rear end region and the above sequence is repeated. As the vehicle 14 moves away from the working face however, the lever 37 engages the rearmost section 16' and the whole series of sections 16 is prevented from moving away with the vehicle 14. Thereby the sections 16 slide over the members 34 and now become supported and stored on the rails 36. As desired, the winch is then used to slide the sections 16 along the rails 36 for take-up by the crane 39 and then by the erecting means 18 to form the lining members 15.

Apparatus made in accordance with the invention can thus enable the sections 16 to be transported and storage efficiently and more or less automatically.

It is possible to further automize the apparatus, as described, for example, by arranging sensing means to operate the units 24 and/or 32 when the vehicle 14 passes a certain location.

Instead of providing the facility of raising and lowering to the rails 23 it is quite feasible to modify the apparatus as illustrated so that the holding means 22 of the vehicle 14 performs this function. Such a raising or lowering can thus enable the sections 16 to be picked up and deposited onto stationary take-up rails 23, 36 and can be initiated by sensors which operate mechanically, hydraulically, electromagnetically or pneumatically.

We claim:

1. Apparatus for use in storing and transporting lining sections in an underground tunnel driving installation; said apparatus comprising a storage station for receiving and storing a series of lining sections in the vicinity of the entrance to a tunnel and a trolley vehicle adapted to move along the tunnel within a previously installed lining, said trolley vehicle having running wheels, a container for receiving debris material removed from a working face during the advancement of the tunnel and holding means serving to receive and support the lining sections to be transported, the holding means being formed beneath the container and comprising plates with concave support surfaces having a curvature conforming to that of the lining sections, the plates being spaced apart laterally of the tunnel and disposed between said running wheels, the trolley vehicle and the storage station being so constructed as to permit the trolley vehicle to travel over the station to pick up lining sections stored thereat with the aid of its holding means.

2. Apparatus for use in storing and transporting prefabricated curvilinear lining sections in an underground tunnel driving installation; said apparatus comprising a storage station for receiving and storing a series of lining sections in the vicinity of the entrance to the tunnel and a wheeled trolley vehicle movable back and forth along the tunnel within a previously installed lining, the vehicle having a container for receiving and transporting debris material removed from a working face during advanceent of the tunnel and holding means for engaging and supporting the lining sections to be transported from the storage station to the front working-face end of the tunnel, the holding means being shaped to conform with the curvature of the lining sections and disposed beneath the container to permit the vehicle to travel over said storage station to receive the lining sections.

3. Apparatus according to claim 2, and further comprising means for effecting relative movement between the storage station and the holding means whereby to effect transfer of the lining sections from the storage station to the holding means.

4. Apparatus according to claim 2, wherein at least part of the storage station can be raised and lowered to effect transfer of the lining sections from the storage station to the holding means.

5. Apparatus according to claim 4, wherein said at least part of the storage station can permit the lining sections stored thereat to be raised to allow the vehicle and holding means to pass the lining sections and to permit the lining sections to be lowered onto the holding means.

6. Apparatus according to claim 2 and further comprising a further storage station for receiving and storing a series of lining sections in the vicinity of the front end of the tunnel, the further storage station being constructed to permit the trolley vehicle to travel over the further storage station and to deposite lining sections thereon, and the trolley vehicle serving to transfer lining sections between the first-mentioned storage station and the further storage station.

7. Apparatus according to claim 6, wherein there is provided stop means for permitting lining sections supported by the holding means to pass over the further storage station as the vehicle moved towards the front of the tunnel and for causing the lining sections to be transferred from the holding means to the further storage station as the vehicle moves back towards the first-mentioned storage station.

8. Apparatus according to claim 6, wherein the further storage station at least includes parallel rails mounted at the floor of the tunnel, each rail having a T-shaped cross-section with an upper flange onto which the lining sections are placed.

9. Apparatus for use in storing and transporting lining sections in an underground tunnel driving installation; said apparatus comprising a storage station for receiving and storing a series of lining sections in the vicinity of the entrance to a tunnel and a trolley vehicle adapted to move along the tunnel within a previously installed lining and having holding means which serves to receive and support the lining sections to be transported, the trolley vehicle and the storage station being so constructed as to permit the trolley vehicle to travel over the station to pick up lining sections thereat, wherein at least part of the storage station can be raised and lowered to effect transfer of the lining sections from the stowage station to the holding means and at least part of the storage station is in the form of parallel rails mounted at the floor of the tunnel.

10. Apparatus according to claim 9, wherein the rails have inclined cam surfaces which engage on abutments and there is provided means for moving the rails longitudinally so that the engagement of the cam surfaces with the abutments produces raisinng or lowering of the rails.

11. Apparatus according to claim 10, wherein the rails each have a T-shaped cross section with an upper flange onto which the lining sections are placed and the cam surfaces are located beneath these upper flanges.

12. A method of storing and transporting lining sections in an underground tunnel driving installation; said method comprising arranging a series of lining sections at a first storage station in the vicinity of the tunnel entrance, moving a trolley vehicle along the tunnel and within a previously installed lining towards the entrance to travel over the first storage station, transferring the lining sections from the first storage station to holding means of the vehicle, moving the vehicle towards the front end of the tunnel to travel over a second storage station in the vicinity of the front end of the tunnel and transferring the lining sections from the holding means to the second storage station.

13. A method according to claim 12, wherein the trolley vehicle is also utilized to transport debris material away from the front end of the tunnel.

14. A method according to claim 12, wherein the transference of lining sections between at least the first storage station and the holding means is effected by relative vertical movement therebetween.

15. A method according to claim 12, wherein the transference of lining sections between the holding means and the second storage station is effected by restraining the lining sections from moving with the vehicle when the latter moves towards the first storage station so that the lining sections slide along the holding means onto the second storage station.

16. A tunnel driving installation comprising a moveable shield, a cutting head for detaching material from a working face to effect advancement of the tunnel, a movable trolley vehicle having a container supported on running wheels, a conveyor for conveying debris material to the container of said trolley vehicle, a first storage station located at a rear end region of the tunnel remote from the shield and the cutting head, a second storage station located at the front end region of the tunnel in the vicinity of the shield and the cutting head, each storage station having floor rails serving to receive and store a series of individual tunnel lining sections used to construct a permanent lining for the tunnel, shaped holding means disposed beneath the container and between the running wheels of the trolley vehicle for supporting said lining sections, the vehicle and its holding means being displaceable over the storage stations, means for transferring the lining sections between the first storage station and the holding means of the vehicle, and means for transferring the lining sections between the holding means and the second storage station, whereby the trolley vehicle can transfer the lining sections from the first storage station to the second storage station in moving towards the front end region of the travel and the trolley vehicle can transport the debris material away from the front end region in moving back to the first storage station.

* * * * *